US011243039B2

(12) United States Patent
Gardner, Jr. et al.

(10) Patent No.: US 11,243,039 B2
(45) Date of Patent: Feb. 8, 2022

(54) BARREL SECTION FOR REDUCING WATER AND DEBRIS BUILD-UP

(71) Applicant: GOG Paintball, S.A., Plaza Roble Escazu (CR)

(72) Inventors: William M. Gardner, Jr., Loyalhanna, PA (US); Hans Semelsberger, Loyalhanna, PA (US)

(73) Assignee: GOG Paintball, S.A., San Jose (CR)

( * ) Notice: Subject to any disclaimer, the term of this patent is extended or adjusted under 35 U.S.C. 154(b) by 0 days.

(21) Appl. No.: 17/018,174

(22) Filed: Sep. 11, 2020

(65) Prior Publication Data

US 2021/0080214 A1 Mar. 18, 2021

Related U.S. Application Data

(60) Provisional application No. 62/901,617, filed on Sep. 17, 2019.

(51) Int. Cl.

| | |
|---|---|
| ***F41A 21/18*** | (2006.01) |
| ***F41A 21/10*** | (2006.01) |
| *F41B 11/80* | (2013.01) |

(52) U.S. Cl.
CPC ..... *F41A 21/18* (2013.01); *F41A 21/10* (2013.01); *F41B 11/80* (2013.01)

(58) Field of Classification Search
CPC ..... F41A 21/18; F41A 21/10; F41B 11/80
USPC ..... 42/78
See application file for complete search history.

(56) References Cited

U.S. PATENT DOCUMENTS

| | | | | | |
|---|---|---|---|---|---|
| 119,846 | A * | 10/1871 | Henry | F41A 21/18 | 42/78 |
| 296,958 | A * | 4/1884 | Hebler | F41A 21/18 | 42/78 |
| 2,589,738 | A * | 3/1952 | Sedberry | F41A 21/42 | 42/79 |
| 2,766,691 | A * | 10/1956 | Ramey | F41A 21/18 | 244/3.23 |
| 3,100,358 | A * | 8/1963 | Robinson, Jr. | F41A 21/18 | 42/78 |
| 5,228,427 | A * | 7/1993 | Gardner, Jr. | F41A 21/28 | 124/71 |
| 5,640,945 | A * | 6/1997 | Slonaker | F41A 21/00 | 124/56 |
| 6,662,797 | B1 * | 12/2003 | Freeman | F41A 21/20 | 124/83 |
| 9,052,151 | B1 * | 6/2015 | Tseng | F41A 21/16 | |
| 2014/0007857 | A1 * | 1/2014 | Schlosser | F41A 21/16 | 124/81 |

(Continued)

*Primary Examiner* — Samir Abdosh

(74) *Attorney, Agent, or Firm* — Craig R. Rogers; Simple IP Law, P.C.

(57) ABSTRACT

An barrel (or barrel section) for a pneumatic gun can comprise a plurality of grooves and ridges arranged in parallel straight lines. The ridges may have a substantially arch-shaped cross-section with a rounded upper surface to provide minimal contact with a projectile such as a paintball being launched through the barrel. The grooves preferably provide channels to permit water and debris to be expelled from the barrel without interfering with the projectile travel. A plurality of apertures may be formed through a sidewall of the barrel along one or more of the grooves to further help expel water and debris, to impart spin to the projectile, and/or to improve a sound signature of the barrel.

20 Claims, 4 Drawing Sheets

(56) References Cited

U.S. PATENT DOCUMENTS

| | | | | |
|---|---|---|---|---|
| 2015/0007479 | A1* | 1/2015 | Kunau | F41A 21/18 42/78 |
| 2019/0145726 | A1* | 5/2019 | Theriault | F41A 21/18 89/14.7 |

* cited by examiner

BARREL SECTION FOR REDUCING WATER AND DEBRIS BUILD-UP

PRIORITY CLAIM

Prior Applications

This application claims priority from U.S. Provisional Patent Application Ser. No. 62/901,617, filed Sep. 17, 2019, the contents of which are hereby incorporated herein by reference in their entirety.

BACKGROUND OF THE INVENTION

Field of the Invention

This invention relates generally to barrels for paintball and other pneumatic guns. More particularly, this invention relates to a barrel designed to keep water and debris from collecting in the barrel.

Related Art

Pneumatic guns such as paintball guns, airsoft guns, bb guns, pellet guns, and the like, use barrels to direct the projectile from the gun toward the target. Spin may be imparted to the projectiles through air ports or rifling formed in the barrel. Unfortunately, conventional pneumatic gun barrels may allow for the accumulation of water or debris in the barrel that can interfere with the proper functioning of the barrel. An improved barrel design for a pneumatic gun that reduces or eliminates the accumulation of, and interference by, water and/or other debris is therefore desired.

SUMMARY OF THE INVENTION

According to various embodiments and principles of the present invention, a barrel for a pneumatic gun can provide numerous improvements over the prior art, including, for instance, a design that limits or eliminates the accumulation of water and/or other debris in the barrel and limits the interference between barrel fouling materials and a projectile.

Specifically, according to principles of the present inventive concepts, a barrel section can comprise ridges and valleys formed in a straight line (without twist), preferably from the front of the barrel toward the rear of the barrel. Unlike conventional rifling ridges, these ridges do not impart twist or spin to the projectile being launched through the barrel. In addition, the valleys between the ridges are much deeper than traditional rifling grooves. By providing deeper grooves between the ridges and arranging the grooves in a straight line, water and debris that may be introduced into the barrel can be quickly expelled without interfering with the barrel's performance. In addition, by providing ridges with minimal contact surface area, friction between the barrel and projectile can be reduced to provide a more efficient barrel.

More particularly, rounded (or arched) ridges can help ensure that any water or debris found in the barrel section will be forced into and collect in the valleys between the ridges. Because the valleys are deeper than traditional rifling grooves, the water or debris in the valleys is less likely to contact the projectile and interfere with its travel through the barrel section. In addition, because the valleys are straight (without twist), the water and debris collected in the valleys can travel more easily out of the barrel.

The ridges and valleys may be formed, for instance, during an extrusion or drawing process. According to a preferred method of manufacturing, a tube is extruded or drawn past a die having the desired pattern for forming the ridges and valleys. In this manner, the pattern on the inside diameter of the tube can be formed on a desired length of the tube.

In one embodiment, the ridges and valleys can each have a substantially semi-circular cross-section. By providing ridges with a semi-circular cross-section, a surface area with minimal contact between the barrel and the projectile can be provided. Friction between the barrel and the projectile can therefore be reduced and the efficiency of the barrel can be improved. Air ports can also be provided along a length of the barrel section to impart spin, allow for expulsion of water or debris, and/or improve a sound signature of the barrel.

A tube can be cut into barrel sections, each having a desired length, before or after the extrusion or drawing process. Each barrel section can be provided with a connection mechanism, such as threading, to enable the barrel to be connected to a pneumatic gun or another barrel section.

A front barrel section (or "barrel front") according to principles of the present inventive concepts can comprise a connection mechanism for connecting to a rear barrel section (or "barrel back"). The pattern of straight ridges and valleys can be formed on an internal diameter of the barrel front.

Of course, the inventive principles are not limited thereto, and various aspects, embodiments, and configurations of this invention are possible without departing from the principles disclosed herein. For instance, the principles of this invention could also be used for barrels for firearms and other types of guns, in addition to pneumatic guns. This invention is therefore not limited to any of the particular aspects, embodiments, or configurations described herein.

BRIEF DESCRIPTION OF DRAWINGS

The foregoing and additional objects, features, and advantages of the present invention will become more readily apparent from the following detailed description of preferred embodiments, made with reference to the accompanying drawings, in which.

DETAILED DESCRIPTION OF ILLUSTRATIVE EMBODIMENTS

Embodiments of the present inventive concepts are shown in the accompanying drawings to illustrate various features, benefits, and configurations thereof. Additional features, benefits, and configurations will be readily apparent to those of ordinary skill in the art based on this disclosure, and all such features, benefits, and configurations are considered within the scope of the present invention. Various illustrative embodiments will now be described in further detail in connection with the accompanying drawings.

Figure 1:
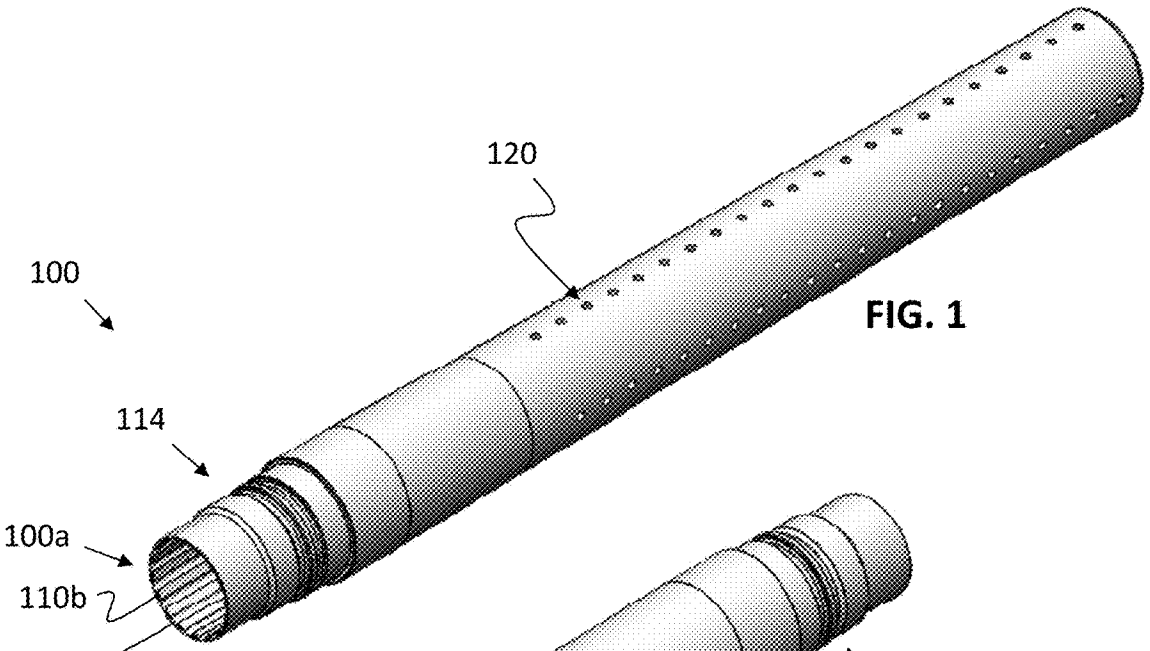
FIG. 1 is a somewhat schematic perspective view of a pneumatic gun barrel section having ridges and valleys formed along an internal diameter of the barrel section in a straight line to prevent the build-up of water and/or debris.
Figure 2:
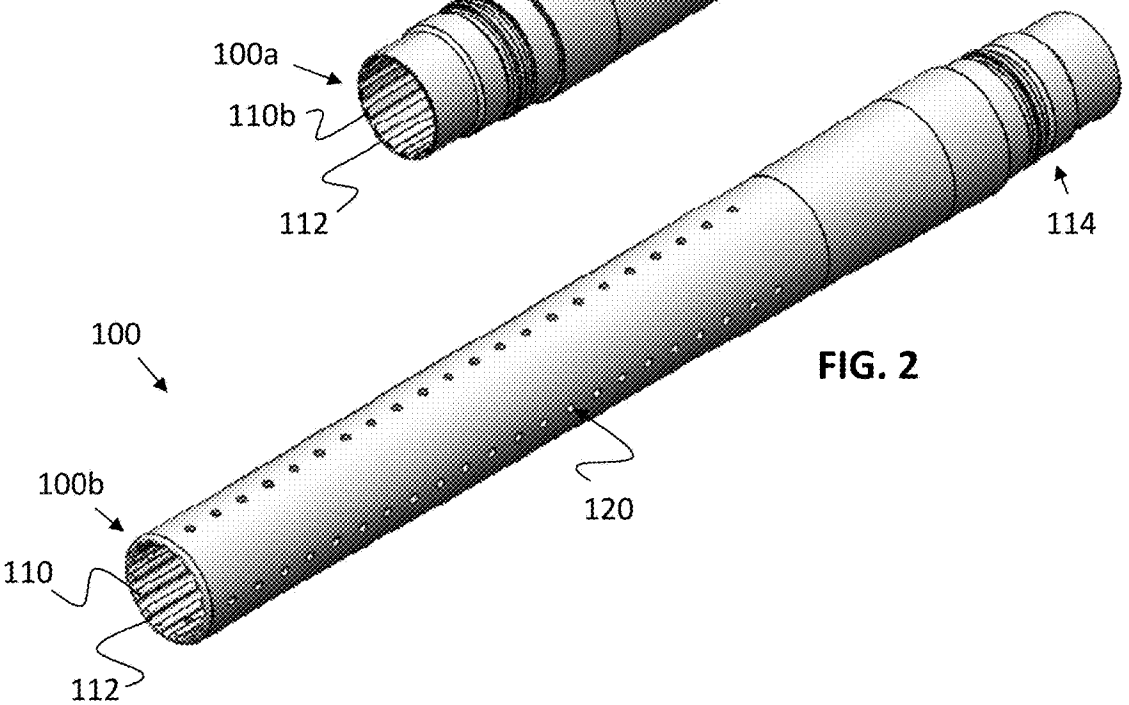
FIG. 2 is another somewhat schematic perspective view of the barrel section of FIG. 1.
Figure 3:
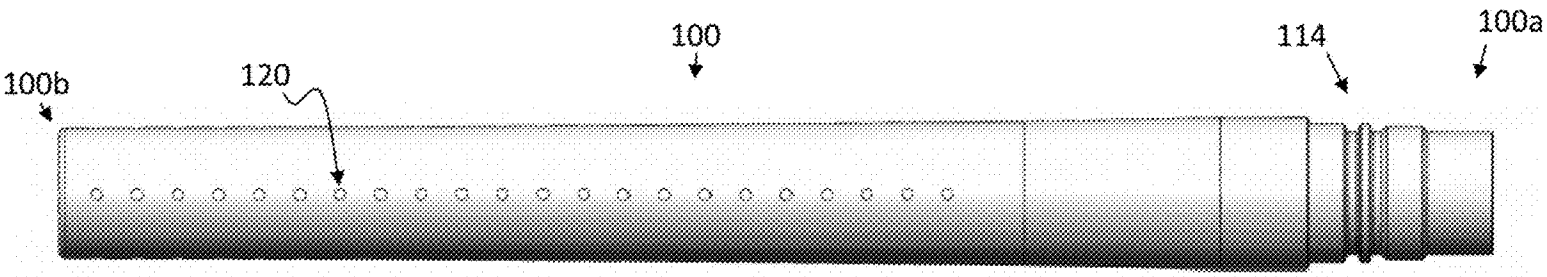
FIG. 3 is a somewhat schematic side view of the barrel section of FIG. 1.
Figure 4:
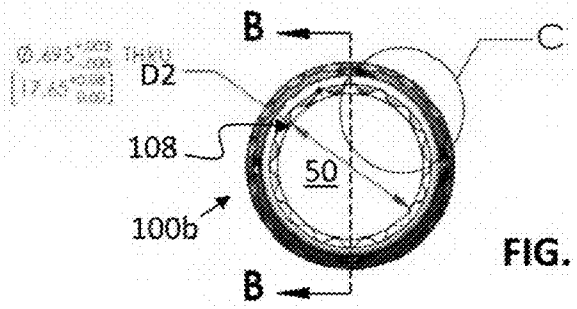
FIG. 4 is a somewhat schematic front view of the barrel section of FIG. 1.
Figure 5:
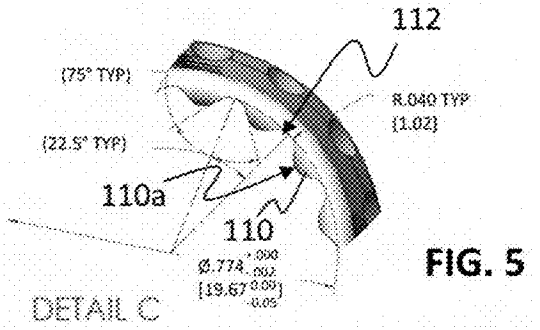
FIG. 5 is a somewhat schematic detail view of Section C of the barrel section of FIG. 4, illustrating a portion of the barrel section in more detail.
Figure 6:
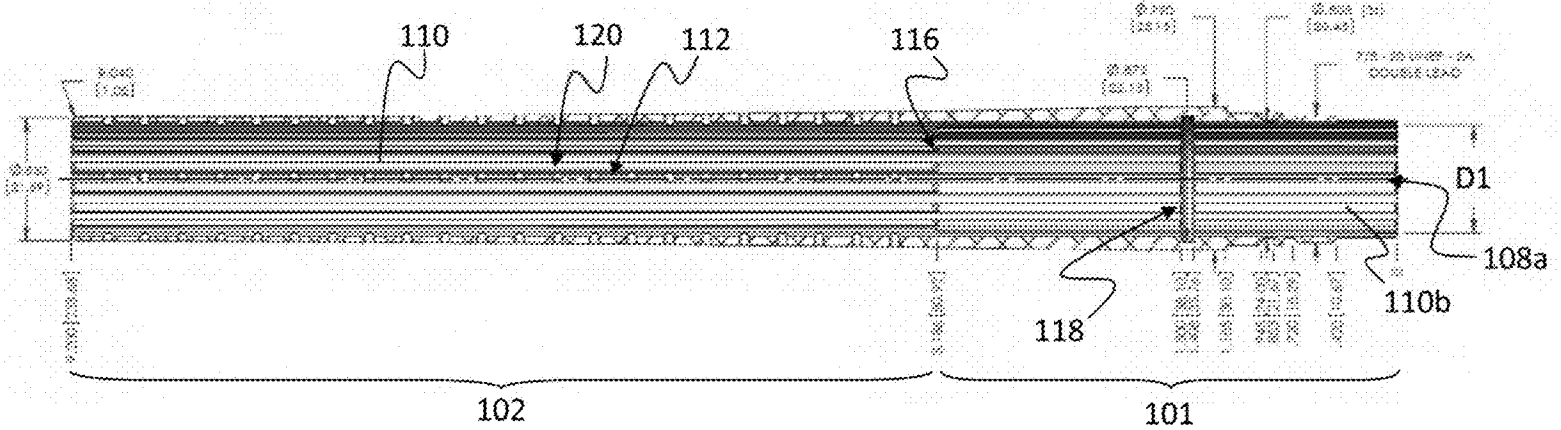
FIG. 6 is a somewhat schematic cross-sectional side view of the barrel section of FIG. 1, taken along section B-B of FIG. 4.
Figures 7, 8:
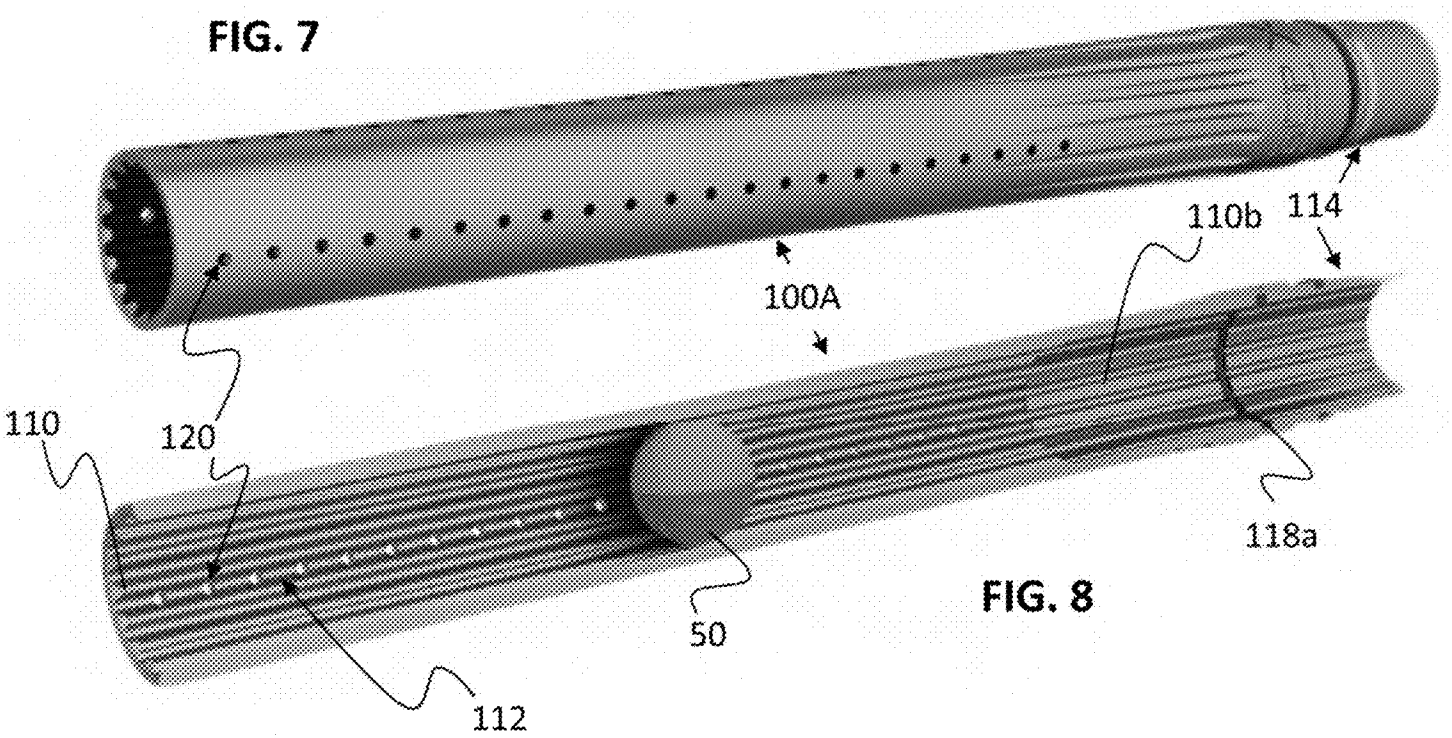
FIG. 7 is a perspective view of a commercial embodiment of a barrel front for a pneumatic gun barrel constructed according to principles of the present inventive concepts.
FIG. 8 is a cross-sectional perspective view of the commercial embodiment of the barrel front of FIG. 7, further illustrating a paintball located within the barrel front.
Figure 9:
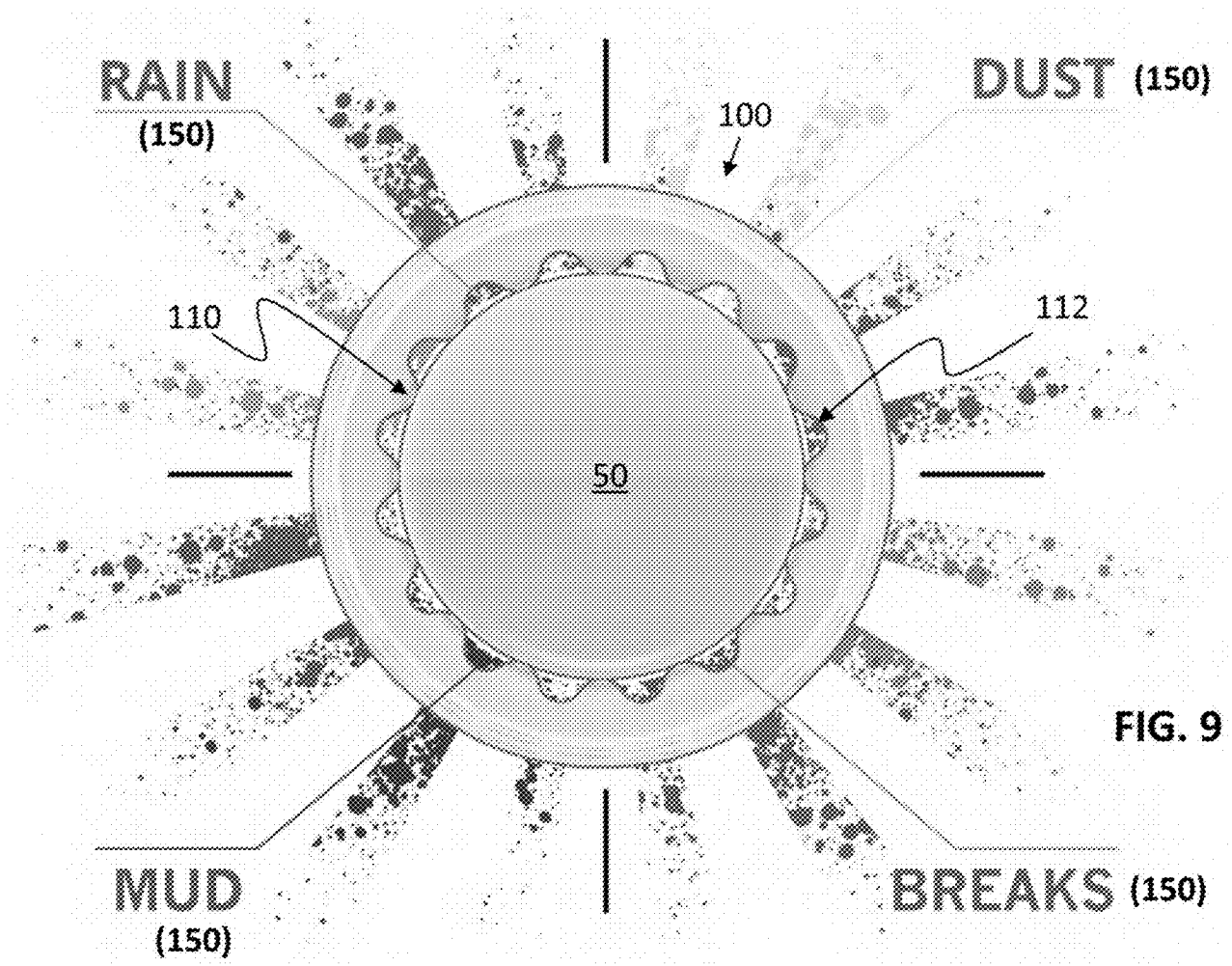
FIG. 9 is a somewhat schematic front view of the commercial embodiment of the barrel front of FIG. 7, schematically illustrating the water and debris removal benefits according to features of the present inventive concepts.

FIG. 1 is a somewhat schematic perspective view of a pneumatic gun barrel section 100 having ridges 110 and valleys 112 formed along an internal diameter 102 of the barrel section 100 in a straight line to prevent the build-up of water and/or debris. FIG. 2 is another somewhat schematic perspective view of the barrel section 100 of FIG. 1. FIG. 3 is a somewhat schematic side view of the barrel section 100 of FIG. 1. FIG. 4 is a somewhat schematic front view of the barrel section 100 of FIG. 1. FIG. 5 is a somewhat schematic detail view of Section C of the barrel section 100 of FIG. 4, illustrating a portion of the barrel section 100 in more detail. FIG. 6 is a somewhat schematic cross-sectional side view of the barrel section 100 of FIG. 1, taken along section B-B of FIG. 4. FIG. 7 is a perspective view of a commercial embodiment of a barrel front 100A for a pneumatic gun barrel constructed according to principles of the present inventive concepts. FIG. 8 is a cross-sectional perspective view of the commercial embodiment of the barrel front 100A of FIG. 7, further illustrating a paintball 50 located within the barrel front 100A. And FIG. 9 is a somewhat schematic front view of the commercial embodiment of the barrel front 100A of FIG. 7, schematically illustrating water and debris removal benefits of the barrel front 100A according to features of the present inventive concepts.

Referring to FIGS. 1-9, in one embodiment, a barrel section 100, such as a barrel front 100A, may be formed having ridges 110 and valleys (or grooves) 112 arranged in a straight line along an internal diameter 108 of the barrel section 100. This barrel section 100 may be formed, for instance, by pressing, pulling, or otherwise extruding or drawing tubing past a die to form the desired pattern.

The barrel section 100 may therefore comprise ridges 110 arranged in straight lines along a desired length thereof, with valleys 112 also arranged in straight lines, each valley 112 arranged between two adjacent ridges 110. In one embodiment, the ridges 110 and valleys 112 may have substantially semi-circular cross-sections. An uppermost surface 110*a* of each of the ridges 110 may be rounded to provide minimal contact with a projectile 50 travelling through the barrel section 100. By providing ridges 110 with minimal contact between the barrel section 100 and the projectile 50, friction between the barrel section 100 and the projectile 50 can be reduced and the overall efficiency of the barrel can be improved.

The cross-sectional dimensions of the ridges 110 may further be substantially uniform between each other, and the cross-sectional dimensions of the valleys 112 may also be substantially uniform between each other. In addition, the ridges 110 and the valleys 112 may be substantially the same size, but inverse shaped. For instance, in some embodiments, a cross-sectional area of each of the ridges 110 may be substantially the same as a cross-sectional area of each of the valleys 112. In one specific embodiment, each of the ridges may be approximately about 0.0445 inches high and each of the grooves may be approximately about 0.0445 inches deep.

The ridges 110 can be configured to extend throughout the entire length of the barrel section 100, or they can extend a predetermined distance along the length of the barrel section 100. For instance, the rounded ridges 110 may extend along a forward portion 102 of the barrel section 100 that extends a predetermined distance from the front 100*a* of the barrel section 100 toward the back 100*b* of the barrel section 100. A rearward portion 101 of the barrel section 100 may have flat ridges 110*b* (rather than semi-circular ridges 110) that provide a larger diameter internal bore 102*a*. For instance, a diameter D1 between the tops of the flat ridges may be approximately about 0.745 inches, while a diameter D2 between the tops of the rounded ridges may be approximately about 0.695 inches. The flat ridges 110*b* may therefore be shorter than the semi-circular ridges 110. The larger diameter D1 of the bore 102*a* of the rearward section 101 may facilitate receiving a barrel insert (not shown), such as that disclosed in U.S. Pat. No. 7,691,759 ("the '759 patent") (incorporated herein by reference in its entirety), therein and the barrel section 100 may, for instance, provide a barrel front for a barrel assembly like that disclosed in the '759 patent. A transition between the flat ridges 110*b* and the semi-circular ridges 110 can provide a stop 116 that keeps the barrel insert from moving further forward in the barrel section 100. The barrel insert may be fully or partially received within the rearward section 101 of the barrel section 100. An o-ring groove 118 can also be provided in the larger diameter rearward portion 101 of the barrel section 100 to receive an o-ring 118*a* that helps provide a secure fit for retaining the barrel insert within the rearward portion 101 of the barrel section 100.

A size of each of the valleys 112 can be configured to permit water and/or other debris 150 to collect in the valleys 112 without interfering with the movement of a projectile 50 through the barrel section 100. The ridges 110 can be designed and arranged to provide minimal contact between the projectile 50 and the barrel section 100 to reduce friction and improve efficiency. By providing straight valleys 112 (with no twist), water and/or other debris 150 collected in the valleys 112 can be more easily discharged from the barrel section 100.

The barrel section 100 may further be provided with a connection mechanism 114 for connection to the pneumatic gun (not shown) or to another barrel section (such as a rear barrel section or barrel back, like that disclosed in the '759 patent). In the case of a barrel front 100A, the barrel front 100A may be provided with a connection mechanism 114 for connecting with a barrel back (not shown), and the barrel back can be provided with a separate connection mechanism for connecting with the pneumatic gun.

In addition, the barrel section 100 may include small openings or air ports 120 arranged through a sidewall of the barrel section 100, for instance, in communication with one or more of the valleys 112. The air ports 120 can be configured to permit expulsion of contaminants 150, impart spin to the projectile 50, and/or improve a sound signature of the barrel. In one embodiment, for example, four sets of air ports 120 can be provided, with each set of air ports 120 being arranged in a respective one of the valleys 112.

Having described and illustrated principles of the present invention in various preferred embodiments thereof, it should be apparent that the invention can be modified in arrangement and detail without departing from such principles. For instance, the rifling patterns could be formed into the separate barrel lengths after they are cut. Furthermore, any desired process for forcing the tubing through the die or die through the tubing could be used to form the ridges and valleys. Still alternatively, various die or tooling configurations could be used to form the pattern on the internal diameter of the barrel section. The barrel could also be configured for guns other than pneumatic guns, such as for firearms. And many other variations are possible within the spirit and scope of these inventive principles.

What is claimed is:

1. A barrel section for a pneumatic gun, said barrel section comprising:

a plurality of ridges and grooves arranged in parallel straight lines from a rearward portion of the barrel section to a forward end of the barrel section; and a plurality of apertures formed through a sidewall of the barrel section along one or more of the grooves to help expel contaminants from the barrel section, wherein the ridges each comprise a rounded uppermost surface to provide minimal contact between the ridges and a projectile travelling through the barrel.

2. The barrel section according to claim 1, further comprising an enlarged internal bore at the rearward end of the barrel section that is configured to receive a barrel insert therein.

3. The barrel section according to claim 2, wherein the ridges arranged in the enlarged internal bore have a flattened uppermost surface to receive and contact the barrel insert.

4. The barrel section according to claim 1, wherein the plurality of apertures comprises four sets of apertures formed along four of the grooves, with each set of apertures formed along a respective one of the grooves.

5. The barrel section according to claim 1, wherein each of the ridges comprises a substantially arch-shaped cross-section.

6. The barrel section according to claim 5, wherein each of the grooves comprises a substantially arch-shaped cross-section, and wherein each of the arch-shaped grooves is arranged between adjacent arch-shaped ridges and extends continuously along the barrel section from the rearward portion of the barrel section to a forward end of the barrel section.

7. The barrel section according to claim 6, wherein the arch-shaped cross-section of each of the ridges and the arch-shaped cross-section of each of the grooves are substantially the same size.

8. The barrel section according to claim 1, wherein the ridges at the rearward-most portion of the barrel section have a reduced height to receive a barrel insert therein.

9. The barrel section according to claim 8, wherein the ridges at the rearward-most portion of the barrel section have a flattened upper surface to contact and retain the barrel insert.

10. The barrel section according to claim 9, wherein the ridges increase in height at a transition point between the flattened upper surface and the rounded uppermost surface of the ridges to provide a stop that retains the barrel insert in place in the rearward-most portion of the barrel section.

11. A barrel front for a pneumatic gun barrel, said barrel front comprising:

a connection mechanism arranged on a rearward end of the barrel front to connect the barrel front to a barrel back;

a plurality of ridges arranged along an internal surface of the barrel front in continuous lines from a rearward portion of the barrel front to a forward portion of the barrel front;

a plurality of grooves arranged between the ridges; and a plurality of apertures formed through a sidewall of the barrel front along one or more of the grooves.

12. The barrel front according to claim 11, wherein the ridges at a rearwardmost end of the barrel front have a reduced height to receive a forward portion of a barrel insert.

13. The barrel front according to claim 11, wherein one or more of the grooves comprises a substantially arch-shaped cross-section having a rounded bottom surface arranged between adjacent ridges.

14. The barrel front according to claim 13, wherein the plurality of ridges comprise one or more substantially arch-shaped ridges having a rounded uppermost surface, and wherein a cross-sectional area of the arch-shaped ridge is substantially the same as the cross-sectional area of the arch-shaped groove.

15. The barrel front according to claim 11, wherein an internal bore measured from the uppermost surfaces of opposing ridges of the rearward end of the barrel front is enlarged to receive a barrel insert.

16. A pneumatic gun barrel comprising:

a plurality of ridges, wherein each ridge is arranged in a straight line from a rearward portion of the barrel to a forward portion of the barrel, wherein the plurality of ridges comprise rounded top surfaces to provide minimal contact area between the barrel and a projectile travelling through the barrel, and wherein the ridges have a reduced height at a rearward-most portion of a barrel section to receive and secure a barrel insert therein; and a plurality of grooves arranged between the plurality of ridges, said grooves configured to collect water or debris from off the ridges and provide a channel for said water or debris to be expelled from the barrel without interfering with the projectile travelling through the barrel.

17. The pneumatic gun barrel according to claim 16, wherein the ridges have a flattened upper surface at the rearward-most portion of the barrel section to contact and retain the barrel insert.

18. The pneumatic gun barrel according to claim 17, wherein the ridges increase in height at a transition point between the flattened upper surface and the rounded top surface of the ridges to provide a stop that retains the barrel insert in place in the rearward-most portion of the barrel section.

19. The pneumatic gun according to claim 16, wherein the plurality of ridges and the plurality of grooves each comprise substantially arch shaped cross sections near the forward portion of the barrel, and wherein an area of the substantially arch-shaped cross section of the grooves is substantially the same as an area of the substantially arch-shaped cross section of the ridges.

20. The pneumatic gun barrel according to claim 16, further comprising a plurality of apertures formed through a sidewall of the pneumatic gun barrel along one or more of the grooves.

* * * * *